United States Patent [19]

Alsop

[11] Patent Number: 4,738,063

[45] Date of Patent: Apr. 19, 1988

[54] GROUND ANCHORING SYSTEM

[76] Inventor: Peter Alsop, St. Georges House, Ivychurch, Kent, England

[21] Appl. No.: 784,879

[22] PCT Filed: Jan. 29, 1985

[86] PCT No.: PCT/GB85/00041

§ 371 Date: Sep. 30, 1985

§ 102(e) Date: Sep. 30, 1985

[87] PCT Pub. No.: WO85/03319

PCT Pub. Date: Aug. 1, 1985

[30] Foreign Application Priority Data

Jan. 30, 1985 [GB] United Kingdom ..... 8402362

[51] Int. Cl.[4] ..... E02D 5/80

[52] U.S. Cl. ..... 52/163; 52/155; 52/162

[58] Field of Search ..... 52/155, 158, 159, 162, 52/163, 165

[56] References Cited

U.S. PATENT DOCUMENTS

| | | | |
|---|---|---|---|
| 227,257 | 5/1880 | Irion | 52/155 |
| 4,38,683 | 1/1982 | Lee | 52/162 |
| 1,273,890 | 7/1918 | Loseth | 52/162 |
| 1,566,846 | 12/1925 | Fielding | 52/163 |
| 1,955,902 | 4/1934 | Bullard | 52/163 |
| 1,982,963 | 12/1934 | Post | 52/162 |
| 3,282,002 | 11/1966 | Jefferson | 52/162 |
| 3,888,057 | 6/1975 | Zubke | 52/163 |
| 3,986,366 | 10/1976 | Dinsmore, Jr. | 52/158 |
| 4,003,169 | 1/1977 | Young, II | 52/155 |

FOREIGN PATENT DOCUMENTS

| | | | |
|---|---|---|---|
| 1336507 | 7/1963 | France . | |
| 1453190 | 9/1966 | France . | |
| 2450308 | 10/1980 | France | 52/162 |
| 2470823 | 6/1981 | France . | |
| 802387 | 10/1958 | United Kingdom . | |
| 2085386A | 4/1982 | United Kingdom . | |
| 2089862A | 6/1982 | United Kingdom . | |

*Primary Examiner*—William F. Pate, III
*Assistant Examiner*—Caroline D. Dennison
*Attorney, Agent, or Firm*—Lane & Aitken

[57] ABSTRACT

A ground anchor adapted to be driven into the ground using a driving tool socket affixed near the leading edge of the anchor is disclosed. The anchor comprises a generally flat plate having a hinged, serrated tail flap. After being driven into the ground the anchor is secured in place immediately, without lifting, when tension is applied to a strap attached thereto.

11 Claims, 2 Drawing Sheets

GROUND ANCHORING SYSTEM

BACKGROUND OF THE INVENTION

1. Field of the Invention

The present invention is related to ground anchors. More particularly, the present invention is related to anchors driven into the ground to remain in the position thus established with minimal slippage.

2. Discussion of Related Art

In my published U.K. Patent Application 2 085 386 A there is described a ground anchoring system in which a generally flat anchor plate is secured to one end of a flexible anchor line and driven edge-first into the ground by a driving tool.

When the driving tool is removed and a lifting force is subsequently applied to the flexible line, the plate tends to skew across the hole and thereby resist extraction from the ground. A somewhat similar device is disclosed in U.S. Pat. No. 4,003,169.

On the whole this system works satisfactorily, but I have found that there is often a significant delay before the plate is skewed after a lifting force is applied to the line. During this period, the plate can be pulled some distance back up the hole, and the anchored object may not then be firmly anchored in its desired position. This problem is particularly troublesome when anchoring objects to the river or sea bed. For example, when anchoring a frond mat to the sea bed to combat erosion of the bed beneath structures such as oil or gas pipelines, any "lifting" of the mat after it has been anchoed can seriously affect subsequent performance of the mat under operating conditions.

SUMMARY OF THE INVENTION

An object of the present invention is to provide an anchor plate which overcomes this problem but without substantially increasing the resistance of the plate when being driven downwardly into the ground.

In accordance with one aspect of the present invention there is provided a ground-anchoring system comprising an anchor plate which, in use, is driven edge-first into the ground by a driving tool, the plate being secured to one end of a flexible anchor line, characterised in that a projecting portion of the plate is retained in a first cocked position when driving the plate downwardly into the ground, the said portion being subsequently released from its cocked position to resist reverse upward movement of the plate when the driving tool is withdrawn and the anchor line is tensioned.

The projecting portion of the anchor plate preferably extends rearwardly from a trailing edge of the plate. In its cocked position the extended portion is generally aligned with the plate, the angle being generally in the range of 0° to 15° and preferably less than 10°. It therefore offers minimum resistance to the downward movement of the plate into the ground. In its released position, on the other hand, the angle increases and generally lies in the range of 20° to 60° with a preferred range of 30° to 45°.

The increased angle brings the rear edge of the extended portion into contact with the side of the hold produced by the downward movement of the plate, and the plate therefore pivots about this rear edge into a skew position across the hole when the anchor line is tensioned.

The extended portion is preferably resiliently biased into its released position but may alternatively fall freely into the released position when the driving tool is removed. It may comprise a deformable strip projecting from the trailing edge, or it may be hinged to the trailing edge. In either case it is preferably retained in its cocked position by a co-operating portion of the driving tool so that it is automatically released when the tool is withdrawn.

BRIEF DESCRIPTION OF THE DRAWINGS

By way of example only, an embodiment of the invention will now be described with reference to the accompanying drawings, in which.

DETAILED DESCRIPTION OF A PREFERRED EMBODIMENT

Figure 1:
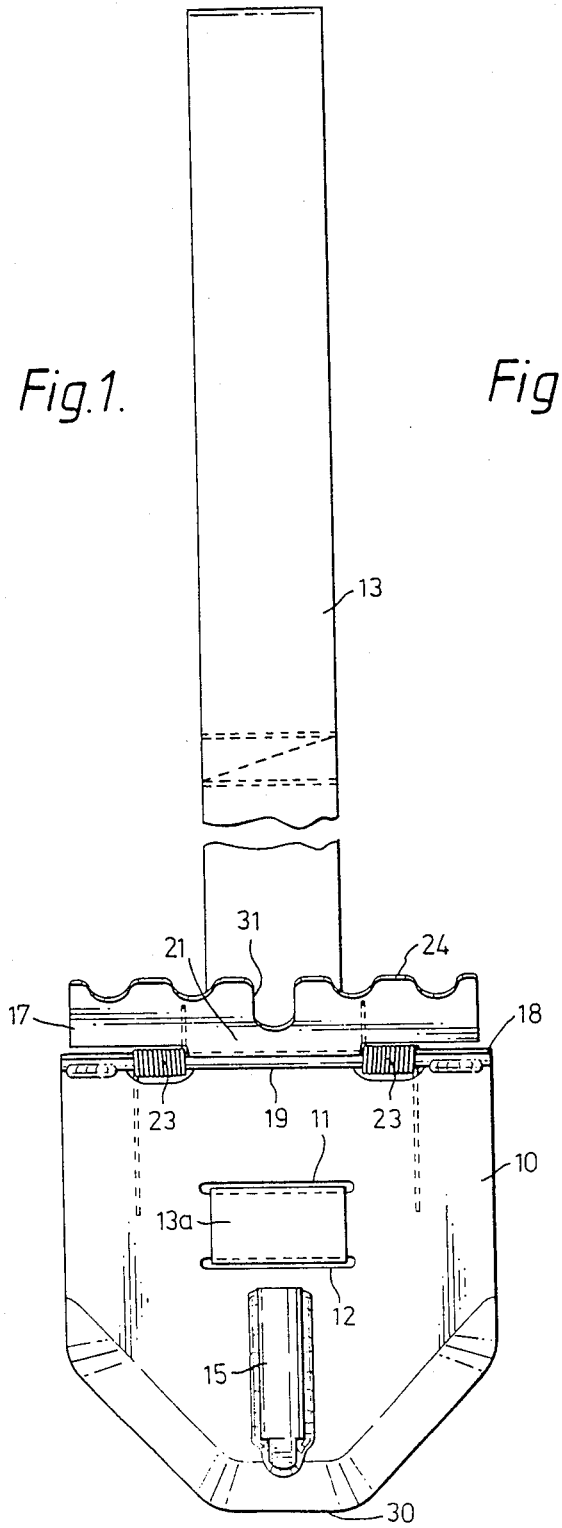
FIG. 1 is a front elevation view of an anchor plate fitted with an anchoring strap.
Figure 2:
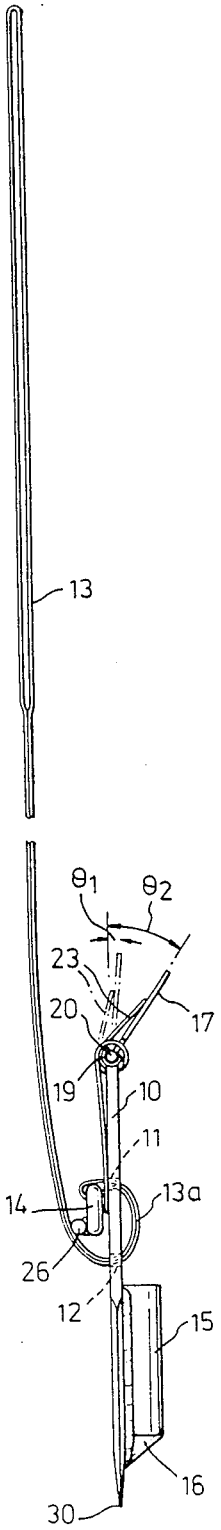
FIG. 2 is a side elevation of the plate and strap.

Referring first to FIGS. 1 and 2, a generally flat, wedge-shaped anchor plate 10 includes a pair of slots 11, 12 for receiving a flexible anchoring strap 13. A looped end of the strap 13 is inserted through the lower slot 12 from the rear side (as viewed in FIG. 1), and is then fed back through the upper slot 11. A split elongate retaining ring 14 receives the looped end and prevents the strap being withdrawn from the slots.

Figure 3:
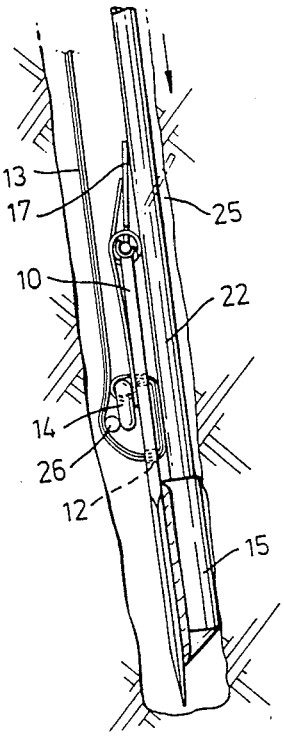
FIG. 3 shows the plate being driven into the ground by a driving tool.

An elongate socket 15 is welded to the front side of the plate 10 for receiving an extended driving rod 22 (FIG. 3) of an hydraulic hammer tool (not shown) such that the leading edge 30 of the plate can be driven downwardly into the ground. As shown in FIG. 3, the rod 22 fits into the socket with a loose push fit and maintains the plate 10 aligned with the rod in a substantially vertical orientation when driving the plate into the ground.

A flap 17 projects rearwardly from the trailing edge 18 of the plate 10. A longitudinally split hollow tube 19 is welded to the trailing edge 18 and pivotally mounts a spindle 20 secured to a central portion 21 of the flap. The flap 17 is thereby hinged to the trailing edge 18 and is movable through an angle determined by the width of the slit in the tube 19. It is resiliently biased by springs 23 into the position shown in full outline in FIG. 2, the angle $\theta_2$ being approximately 40°. The other extreme position is shown by the chain-dot outline in FIG. 2, the angle $\theta_1$ being approximately 5°

Figure 4:
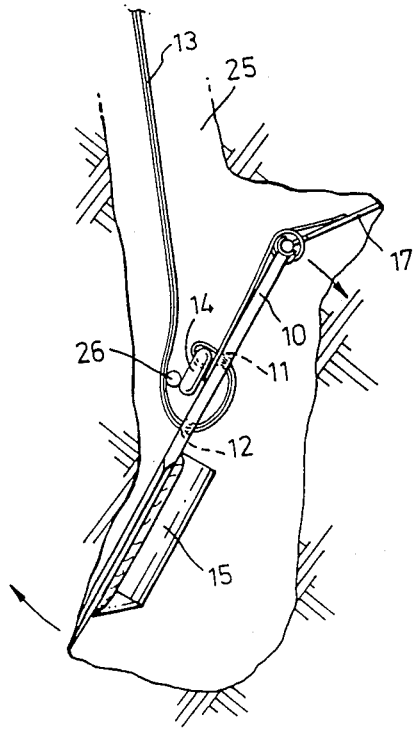
FIG. 4 shows the skew position of the plate when the strap is subsequently tensioned after driving the plate into the ground.

The operation of the system is illustrated in FIGS. 3 and 4. The object being anchored (not shown) is attached to the top end of the strap 13. The driving rod 22 of the hammer tool is then inserted into the socket 15. To insert the rod into the socket, the hinged flap 17 must first be moved back against its resilient bias into the cocked position shown in full outline in FIG. 3. The rod 22 once inserted in socket 15 then holds the flap 17 in its cocked position against the bias of spring 23, the rod being accommodated by the recess 31 (FIG. 1) in the rear edge of the flap.

The hammer is then actuated to drive the plate 10, strap 13 and rod 22 into the ground, the location of rod 22 in socket 15 maintaining the plate aligned in the rod with a generally vertical orientation as shown in FIG. 3.

Once the plate and strap have been driven to the required depth, say 1-2 meters, the rod 22 is withdrawn from socket 15 and the flap 17 automatically springs into the position shown in chain-dot outline in FIG. 3. In this position the serrated rear edge 24 of the flap digs into the side of the hole 25 and thereby resists reverse upward movement of the plate. Moreover it immediately provides a fulcrum about which the plate 10 is forced to pivot to a skew position as shown in FIG. 4 when the strap 13 is subsequently tensioned by lifting forces applied to the object being anchored. This action ensures that the plate is immediately locked in its skew position and cannot be pulled back up the hole.

The centre of gravity of the plate 10 is positioned above the lower slot 12 so that the plate will tend to rotate in the direction shown by the arrows in FIG. 4 when the rod 22 is withdrawn from socket 15. This further assists in urging the serrated edge 24 of flap 17 into engagement with the side of the hole 25.

Moreover, a short bar 26 welded to the ring 14 spaces the strap 13 from the rear face of the plate 10 so that an additional turning moment is applied in the direction of the arrows shown in FIG. 4 when the strap 13 is tensioned. In practice the forces on the plate are such that it continues to rotate into a generally horizontal locked position as the rear edge 24 of the flap 17 digs further into the side of the hole.

I claim:

1. A ground anchoring system comprising:

a driving tool;

an anchor plate; and means located towards a leading edge of the plate and disposed within the periphery of the plate for releasably retaining a driving tool such that the plate is driven edge-first into the ground, said retaining means comprising an elongate socket, the plate being secured to one end of a flexible anchor line which extends upwardly on one side of the plate for connection to an object being anchored, and the plate having a tail section projecting from the opposite side of the plate from the anchor line and movable in a path from a first, cocked position, in which said tail section engages the tool, to a second position inclined at a greater angle to the plate than said first, cocked position, the elongate socket supporting and retaining tool in substantial alignment with the plate and thereby retaining the tail section in its first, cocked position when the plate is driven downwardly into the ground, the tail section being biased for movement into its second position when the driving tool is withdrawn and the anchor line is tensioned, said tail section, in said second position, extending into the position previously occupied by the driving tool, the tool being positioned in the path of movement of said tail section between the first, cocked position and the second position,

*whereby the tail section is urged into engagement* with a side of a channel formed in the ground by downwardly moving plate to provide a fulcrum about which the plate rotates into a skew position across the said channel.

2. A ground anchoring system according to claim 1 in which a trailing edge of the tail section is cut away to accommodate the alignment of the driving tool with the plate.

3. A ground anchoring system according to claim 1 in which the trailing edge of the tail section is serrated.

4. A ground anchoring system according to claim 1 in which the tail section is hinged to the anchor plate.

5. A ground anchoring system according to claim 4 in which the hinge comprises a split hollow tube secured to a rear edge of the plate, the tail section having a spindle inserted within the tube.

6. A ground anchoring system according to claim 1 in which the tail section is resiliently biased into its second position.

7. A ground anchoring system according to claim 1 in which the anchor plate has a generally tapered leading section with a truncated leading edge, the length of the plate being of the same order as its width.

8. A ground anchoring system according to claim 1 in which the anchor line comprises a strap or web, the anchor plate including a pair of transverse slots disposed one above the other for receiving and retaining the strap or web in such a manner that the strap or web extends upwardly on the said one side of the plate when the plate is driven into the ground.

9. A system according to claim 1 in which the tail section is inclined to the plate at an angle not exceeding 15° in its first cocked position.

10. A system according to claim 9 in which the said greater angle lies between 20° and 60°.

11. A system according to claim 8 in which the strap or web passes through the lower of the two slots from the said one side of the plate, returns back from the said opposite side through the upper slot, and then is retained at the one side.

* * * * *